United States Patent [19]

Fish

[11] 4,126,907

[45] Nov. 28, 1978

[54] SPAR FLOAT RECOVERY CAPSULE

[76] Inventor: Donald C. Fish, 3189 Novus St., Sarasota, Fla. 33580

[21] Appl. No.: 805,514

[22] Filed: Jun. 10, 1977

[51] Int. Cl.[2] ..... B63B 21/52

[52] U.S. Cl. ..... 9/9; 43/25

[58] Field of Search ..... 9/8 R, 9; 43/25; 116/124 B; 114/16.5

[56] References Cited

U.S. PATENT DOCUMENTS

| | | | |
|---|---|---|---|
| 2,968,819 | 1/1961 | Jenson | 9/9 |
| 3,049,733 | 8/1962 | Mennenga | 9/9 |
| 3,366,983 | 2/1968 | Adams | 9/9 |

*Primary Examiner*—Trygve M. Blix
*Assistant Examiner*—D. W. Keen

[57] ABSTRACT

An innovative device for the locating and recovery of submerged articles. This device consists of a plastic container and a buoy that is automatically released after being submerged in water. A stout line attached to the buoy and the module container which in turn is securely attached to the article for purpose of recovery. The module is designed to equalize submerged water pressures. This device is primarily, but restricted to recovery of submerged articles weighing under 20 pounds and in water in depths of up to 50 feet.

1 Claim, 3 Drawing Figures

SPAR FLOAT RECOVERY CAPSULE

The primary object of the invention is to provide a new concept in means of attachment and design material, shape and simplicity, for universal usage for locating heavy objects and recovery of articles such as guns, fishing poles, tackle boxes, binoculars, gaffs and other miscellaneous articles commonly lost overboard in either fresh or salt water primarily but not restricted to depths of 50 feet or less.

Other objects of the invention are to provide a new concept and scientific simplified design that provides a secure and simplified means of attachment, a scientifically designed and tested release system, a scientific means of balancing water pressure and a highly visable spar shaped float.

Further objects are to provide a completely non-corrosive device that is not adversely effected by moisture and a pressure balancing system that will not restrict release of the spar buoy float at any depth, also an ejector which assists in the release of the spar buoy float irregardless of the position of the submerged article.

With these and other objects in view, as may appear from the accompanying specification, the invention consists of various features of construction and combination of parts, which will be first described in connection with the accompanying drawings, showing a Spar Float Recovery Capsule of a preferred form embodying the invention and the features forming the invention will be specifically pointed out in the claims.

In the drawings.

Figure 1:
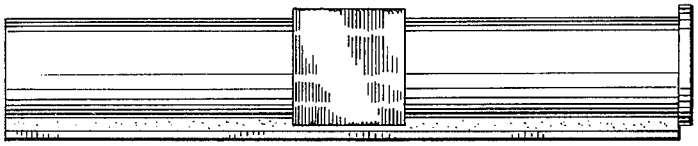
FIG. 1 is a side elevation of the spar buoy recovery capsule.
Figure 3:
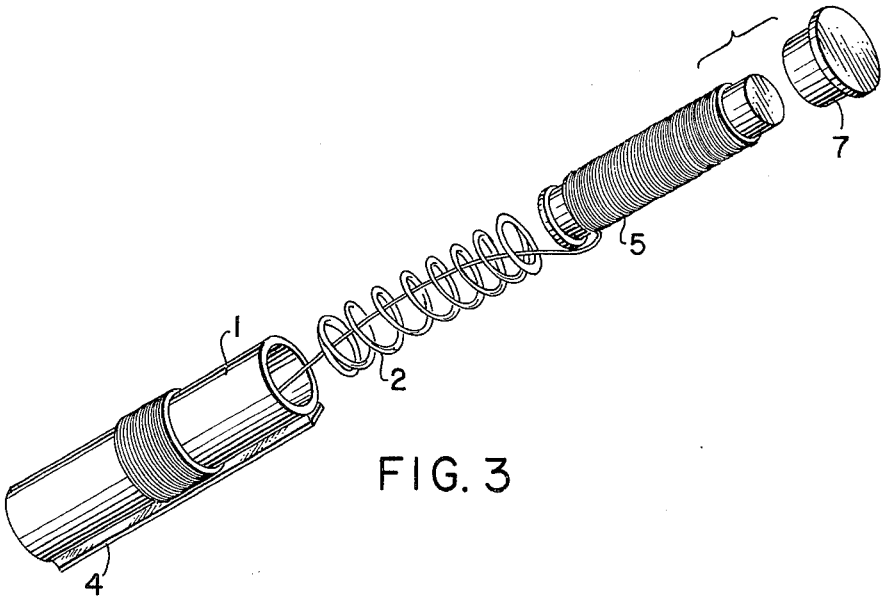
FIG. 3 is an exploded perspective view of the various parts of the device.
Figure 2:
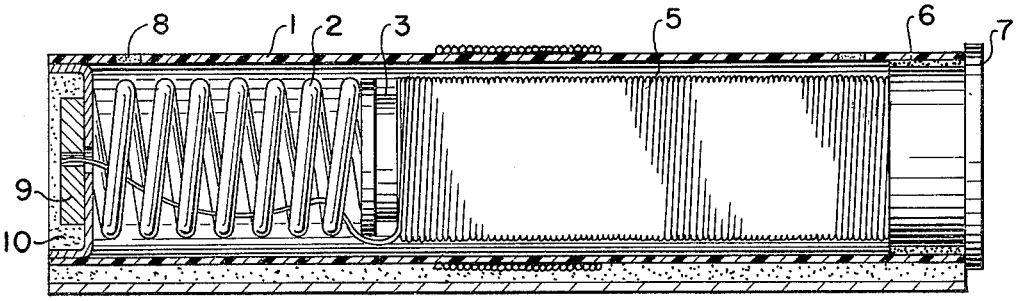
FIG. 2 is an enlarged longitudinal section of the recovery capsule.

Referring more particularly to the drawings, the recovery device includes a cylindrical attachment capsule 1 made of a non-corrosive transparent plastic tube which houses the various parts of the device. The capsule 1 is firmly and securely attached to an article such as a fishing rod, a gun, a tackle box, a gaff or other objects likely to be lost overboard from a boat, by a strip of pressure sensitive adhesive which is weather resistant and waterproof and is pressed tightly against the article to be recovered for firmly and securely attaching the capsule to the article. Said strip of adhesive is, of such sufficient strength as to prevent the capsule from breaking away from the article to be recovered as the article is drawn up through the water by means of the stout recovery line 5. The strip of pressure applied adhesive is of the type that can be purchased on the open market and a protective coating thereon which is stripped from the adhesive strip 4 prior to applying the adhesive strip 4 to the capsule 1.

The recovery capsule 1 has one end closed and the other end open to receive a closure 6 in the form of a delinquescent sealing material which resists normal atmospheric moisture accumulations but which readily dissolves after immersion in water for a few minutes to release the contents of the tube or capsule 1.

A spar shaped float 3 is placed in the capsule 1 with one end against the closure plug 6 and consists of a non-corrosive air tight cylinder of a highly visible color and a stout recovery line 3 is attached to and smoothly wound around the cylindrical marker float 3 for freely unwinding as marker float floats to the surface of the water for easy recovery and the line 3 is also attached firmly to capsule 1.

An ejector spring 2 is placed in the capsule 1 with one end of the spring firmly engaging the float 3 and the other end engaging a keeper 9 which engages the closed end of the capsule 1, and securely connects recovery line 5 to the capsule 1 so that a person may pull the article, to which capsule 1 is attached, upwardly through the water for recovery.

The capsule 1 has a pressure balancing vent 8 near its closed end which is normally sealed by a delinquescent sealing material which resist normal atmospheric moisture accumulations but which readily dissolves when immersed in water for a few minutes to permit equalization of pressure within the capsule when the plug or cap 7 dissolves.

The keeper 9 is cemented as shown at 10 to keep it firmly in place within and attached to the capsule 1.

In operation the capsule 1 is firmly attached by means of the adhesive strip 4 to an article such as a fishing rod, gun, tackle box, etc. and this adhesive strip has sufficient strength to prevent the weight of the article to which the capsule 1 is attached from breaking this connection as the article is lifted through the water by means of the recovery line 5.

The capsule 1 is small and is to be attached to the article in such manner as to preclude its interference with the normal operation of the article.

Prior to the attachment of the capsule 1 to the article the keeper plate 9 is cemented at the closed end of the capsule after which the ejector spring 2 is placed in the capsule. The spar shaped float 3 with the recovery line 5 is then placed within the capsule compressing the ejector spring 2 after which the cap or plug 7 is placed in the open end of the capsule firmly holding the float 3 and the compressed ejector spring 2 in place.

In the event the article to which the capsule 1 is attached falls into the water the cap or plug 7 and the material which closes the equalizing vent 8 will dissolve opening the open end of the capsule 1 and equalizing the pressure within the capsule 1 at which time the ejecting spring 2 will expand forcing the spar shaped float 3 out of the capsule. The float 3 being air tight will then float to the top of the water and can be readily observed by the person in the boat from which the article to which the capsule 1 is attached may readily observe it and moving to the float 3 and grasping the recovery line 5 may then readily draw the article back into the boat.

If the capsule 1 is attached to an article of greater weight than can be supported by the recovery line 5 the float will indicate the position of the sunken article so as to permit suitable recovery means to be employed for the recovery of the article.

However, the present device is particularly adapted to articles weighing not more than 20 pounds from water of a depth of approximately 50 feet and with the recovery line 5 being of a tensile strength of approximately 20 pounds, the article can be readily drawn up through the water and recovered.

It will be understood that the invention is not to be limited to the specific construction or arrangement of parts shown, but that they may be modified within the invention defined by the claims.

What is claimed is:

1. A spar float recovery capsule for attachment to various articles, such as fishing rod, a gun, a tackle box etc. which may accidently drop out into the water, a cylindrical capsule of water resistant material havine one end open and the other end closed, an expansion spring in said capsule, an airtight highly colored cylindrical float in said capsule having one end engaging said spring, a recovery line freely wound around the outer surface of said float, said recovery line of sufficient strength to support the article to which the cylinder is attached as the article is drawn upwardly through the water, a keeper plate in said cylinder and attaching the recovery line to the cylinder whereby the article to which the cylinder is attached may be drawn upwardly through the water and recovered, a plug of a delinquescent sealing material which resist normal atmospheric moisture accumulations but which dissolves after a predetermined interval of immersion in water to open the open end of the capsule at which time the ejection spring being released from pressure ejects the cylindrical float from the capsule and allows it to float to the surface of the water, said capsule has a pressure equalizing opening therein at the inner end of the expansion spring, said opening normally closed by a delinquescent sealing material which resists normal atmospheric moisture accumulation but which dissolves when immersed in water whereby when the article to which the capsule is attached falls into the water the sealing material closing the pressure equalizing opening will dissolve thereby equalizing the pressure within the capsule and allowing the expansion spring to quickly expand and force the float out of the capsule, and means for attaching the cylindrical capsule to the article to be salvaged, said attaching means providing sufficient attachment strength to permit the article to be drawn upwardly through the water in which it has become submerged.

* * * * *